US008827669B2

(12) United States Patent
North et al.

(10) Patent No.: US 8,827,669 B2
(45) Date of Patent: Sep. 9, 2014

(54) SCREW PUMP HAVING VARYING PITCHES

(75) Inventors: Michael Henry North, Redhill (GB); Neil Turner, Godalming (GB); Tristan Richard Ghislain Davenne, Shoreham-by-Sea (GB); Timothy Charles Draper, East Grinstead (GB)

(73) Assignee: Edwards Limited, Crawley, West Sussex (GB)

( * ) Notice: Subject to any disclaimer, the term of this patent is extended or adjusted under 35 U.S.C. 154(b) by 1246 days.

(21) Appl. No.: 12/086,034

(22) PCT Filed: Dec. 4, 2006

(86) PCT No.: PCT/GB2006/050426

§ 371 (c)(1),
(2), (4) Date: Nov. 19, 2009

(87) PCT Pub. No.: WO2007/068973

PCT Pub. Date: Jun. 21, 2007

(65) Prior Publication Data

US 2010/0296958 A1 Nov. 25, 2010

(30) Foreign Application Priority Data

Dec. 13, 2005 (GB) ..... 0525378.6
Sep. 5, 2006 (GB) ..... 0617388.4

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 18/16*** | (2006.01) |
| ***F04C 18/08*** | (2006.01) |

(52) U.S. Cl.
CPC ..... *F04C 18/16* (2013.01); *F04C 18/084* (2013.01); *F04C 2250/201* (2013.01)
USPC ..... 418/194; 418/9; 418/201.1

(58) Field of Classification Search
USPC ..... 418/5, 9, 15, 194, 201.1–201.3
See application file for complete search history.

(56) References Cited

U.S. PATENT DOCUMENTS 2,543,894 A * 3/1951 Colombo ..... 425/204
5,564,907 A 10/1996 Maruyama et al.

(Continued)

FOREIGN PATENT DOCUMENTS

DE 87685 C * 6/1895 ..... F01C 3/08
DE 198 00 711 A1 7/1999

(Continued)

OTHER PUBLICATIONS

Yanagisawa Seiji, Ishigaki Tatsuya, Yoshida Masao; English language abstract of Japanese Publication No. JP 62197681 A; entitled "Screw Pump," Hitachi Ltd; Sep. 1, 1987.

(Continued)

*Primary Examiner* — Theresa Trieu
(74) *Attorney, Agent, or Firm* — Westman, Champlin & Koehler, P.A.

(57) ABSTRACT

A screw pump includes a stator having a fluid inlet and a fluid outlet, the stator housing first and second externally threaded, tapered rotors mounted on respective shafts and adapted for counter-rotation within the stator to compress fluid passing from the fluid inlet to the fluid outlet, wherein the threads have a pitch that increases towards the fluid outlet.

23 Claims, 3 Drawing Sheets

(56) References Cited

U.S. PATENT DOCUMENTS

| | | | | |
|---|---|---|---|---|
| 6,200,116 | B1 * | 3/2001 | Schofield et al. | 418/194 |
| 6,217,305 | B1 * | 4/2001 | Schofield et al. | 418/194 |
| 6,257,854 | B1 | 7/2001 | Fang et al. | |
| 6,702,558 | B2 * | 3/2004 | Becher | 418/201.1 |
| 2003/0152475 | A1 | 8/2003 | Becher | |

FOREIGN PATENT DOCUMENTS

| | | | | |
|---|---|---|---|---|
| DE | 103 34 484 | A1 | 3/2005 | |
| EP | 0 965 758 | A2 | 12/1999 | |
| EP | 0 995 879 | A1 | 4/2000 | |
| EP | 1 111 243 | A3 | 5/2002 | |
| GB | 1 379 575 | | 1/1975 | |
| JP | 62-197681 | | 9/1987 | |
| JP | 6129384 | A | 5/1994 | |
| JP | 11270485 | A * | 10/1999 | F04C 29/00 |
| JP | 2002061589 | A | 2/2002 | |
| WO | 2004036049 | A1 | 4/2004 | |

OTHER PUBLICATIONS

United Kingdom Search Report of Application No. GB0525378.6 dated Mar. 23, 2006; Claims searched: 1-10; Date of search: Mar. 22, 2006.

PCT Notification of Transmittal of the International Search Report and the Written Opinion of the International Searching Authority, or the Declaration.

Of International Application No. PCT/GB2006/050426; Date of Mailing: Mar. 15, 2007.

PCT International Search Report of International Application No. PCT/GB2006/050426; Date of Mailing of the International Search Report: Mar. 15, 2007.

PCT Written Opinion of the International Searching Authority of International Application No. PCT/GB2006/050426; Date of mailing: Mar. 15, 2007.

Prosecution history of corresponding Chinese Application No. 200680046951.6 including: First Office Action dated Nov. 20, 2009; Second Office Action dated Dec. 10, 2010; Third Office Action dated Jul. 8, 2011; Decision on Rejection dated Mar. 31, 2012.

Prosecution history of corresponding European Application No. 06820652.3 including: Communication dated Jul. 13, 2011.

Prosecution history of corresponding Japanese Application No. 2008-545113 including: Notification of Reason for Rejection dated Feb. 13, 2012; Notification of Reason for Rejection dated Sep. 10, 2012.

Prosecution history of corresponding Korean Application No. 2008/7014184 including: Notice of Preliminary Rejection dated Nov. 2012.

* cited by examiner

SCREW PUMP HAVING VARYING PITCHES

FIELD OF THE INVENTION

This invention relates to a screw pump.

BACKGROUND OF THE INVENTION

Screw pumps are potentially attractive since they can be manufactured with few working components and they have an ability to pump from a high vacuum environment at the inlet down to atmospheric pressure at the outlet. Screw pumps usually comprise two spaced parallel shafts each carrying externally threaded rotors, the shafts being mounted in a pump body such that the threads of the rotors intermesh. Close tolerances between the rotor threads at the points of intermeshing and with the internal surface of the pump body, which acts as a stator, causes volumes of gas being pumped between an inlet and an outlet to be trapped between the threads of the rotors and the internal surface and thereby urged through the pump as the rotors rotate.

During use, heat is generated as a result of the compression of the gas by the rotors. Consequently, the temperature of the rotors rapidly rises, most notably at the stages of the rotors proximate the outlet from the pump. By comparison, the bulk of the stator is large and so the rate of heating of the stator is somewhat slower than that of the rotor. This produces a disparity in temperature between the rotors and the stator which, if allowed to build up unabated, could result in the rotors seizing within the stator as the clearance between the rotors and the stators is reduced.

It is known, for example from our International patent application no. WO 2004/036049, to provide a system for cooling the rotors of a screw pump in which a coolant is conveyed into, and subsequently out from, a cavity formed in the end of each rotor of a screw pump. Whilst able to provide effective cooling of the rotors, such a system tends to be relatively expensive to implement, both in view of the complexity of the system and the cost of the components of the system.

SUMMARY OF THE INVENTION

In a first aspect, the present invention provides a screw pump comprising a stator having a fluid inlet and a fluid outlet, the stator housing first and second externally threaded rotors mounted on respective shafts and adapted for counter-rotation within the stator to compress fluid passing from the fluid inlet to the fluid outlet, the axial cross-section of the rotors varying from the fluid inlet towards the fluid outlet, and the threads having a pitch that increases towards the fluid outlet.

In a second aspect of the present invention, a screw pump comprises a stator having a fluid inlet and a fluid outlet, the stator housing first and second externally threaded, tapered rotors mounted on respective shafts and adapted for counter-rotation within the stator to compress fluid passing from the fluid inlet to the fluid outlet, the threads having a pitch that increases towards the fluid outlet.

In a third aspect, the present invention provides a screw pump comprising a stator having a fluid inlet and a fluid outlet, the stator housing first and second externally threaded, tapered rotors mounted on respective shafts and adapted for counter-rotation within the stator to compress fluid passing from the fluid inlet to the fluid outlet, each rotor comprising a first section proximate the fluid inlet and a second section proximate the fluid outlet, wherein the thread of the second section has a pitch that increases towards the fluid outlet.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
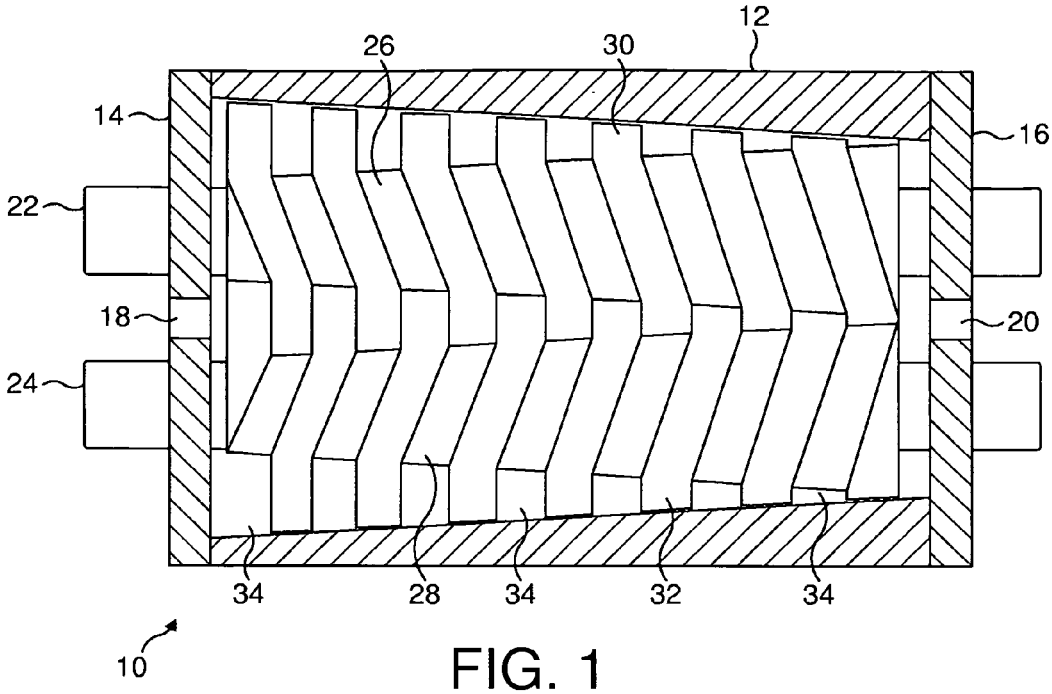
FIG. 1 illustrates a cross-sectional view of a screw pump.

In a first aspect, the present invention provides a screw pump comprising a stator having a fluid inlet and a fluid outlet, the stator housing first and second externally threaded rotors mounted on respective shafts and adapted for counter-rotation within the stator to compress fluid passing from the fluid inlet to the fluid outlet, the axial cross-section of the rotors varying from the fluid inlet towards the fluid outlet, and the threads having a pitch that increases towards the fluid outlet.

By varying the axial cross-section of the rotors together with increasing the pitch of the threads, a screw pump having improved pumping capacity at pressures near to atmospheric conditions can be achieved whilst keeping the power requirements low when pumping at ultimate. The volumetric capacity of each stage of the rotor can be selected to accommodate the aforementioned conditions in an optimum manner. For example, the inlet stages may each have a large volumetric capacity and be substantially similar to one another. Conversely, the exhaust stages may each have a small volumetric capacity and be substantially similar in volume to one another.

In a second aspect of the present invention, a screw pump is provided comprising a stator having a fluid inlet and a fluid outlet, the stator housing first and second externally threaded, tapered rotors mounted on respective shafts and adapted for counter-rotation within the stator to compress fluid passing from the fluid inlet to the fluid outlet, the threads having a pitch that increases towards the fluid outlet.

The locus of the radial extremity of the axial cross section of each rotor may vary from the fluid outlet towards the fluid inlet thereby to effect a change in contact surface of each rotor.

The pitch of the threads may increase progressively from the fluid inlet to the fluid outlet. The pitch of the threads may increase from part way along the rotor to the fluid outlet.

In a third aspect, the present invention provides a screw pump comprising a stator having a fluid inlet and a fluid outlet, the stator housing first and second externally threaded, tapered rotors mounted on respective shafts and adapted for counter-rotation within the stator to compress fluid passing from the fluid inlet to the fluid outlet, each rotor comprising a first section proximate the fluid inlet and a second section proximate the fluid outlet, wherein the thread of the second section has a pitch that increases towards the fluid outlet.

The pitch of the thread of the first section may be substantially constant or it may vary towards the fluid outlet. The pitch of the thread of the first section may decrease towards the fluid outlet.

The first section may comprise a first sub-section proximate the fluid inlet, and a second sub-section proximate the second section, and wherein the pitch of the thread of the first sub-section is different to that of the thread of the second sub-section. The pitch of the second sub-section may decrease towards the fluid outlet. The pitch of the first sub-section may increase towards the fluid outlet.

The threads may have a rectangular cross section. Alternatively, the threads may have a conjugate form.

In the context of the present invention, conjugate is used in relation to the form of the rotors and refers to the relationship between a pair of rotors in which the shape of one rotor is determined by the shape of the other rotor. A very close coupling can be achieved between conjugate rotors, resulting in good sealing properties between the rotors.

With reference first to FIG. 1, a screw pump 10 includes a stator 12 having a top plate 14 and a bottom plate 16. A fluid inlet 18 is formed in the top plate 14, and a fluid outlet 20 is formed in the bottom plate 16. The pump 10 further includes a first shaft 22 and, spaced therefrom and parallel thereto, a second shaft 24 having longitudinal axes substantially orthogonal to the top plate 14 and bottom plate 16. Bearings (not shown) are provided for supporting the shafts 22, 24. The shafts 22, 24 are adapted for rotation within the stator about their longitudinal axes in a contra-rotational direction. One of the shafts 22, 24 is connected to a drive motor (not shown), the shafts being coupled together by means of timing gears (not shown) located in a gear box so that in use the shafts 22, 24 rotate at the same speed but in opposite directions.

A first rotor 26 is mounted on the first shaft 22 for rotary movement within the stator 12, and a second rotor 28 is similarly mounted on the second shaft 24. Roots of each of the two rotors 26, 28 have a shape that tapers from the fluid outlet 20 towards the fluid inlet 18, and each root has a helical vane or thread 30, 32 respectively formed on the outer surface thereof so that the threads intermesh as illustrated. Tapering the rotors 26, 28 in this manner serves to increase the surface area of the rotor at the exhaust stages of the rotors, consequently the contact surface area between the tip of the threads and the stator is increased such that heat transfer path therebetween is correspondingly improved.

The shape of the rotors 26, 28 and the threads 30, 32 relative to each other and to the inner surface of the stator 12 are calculated to ensure close tolerances with the inner surface of the stator 12. The rotors 26, 28 and the threads 30, 32 also define with the inner surface of the stator 12 a fluid chamber 34 that progressively decreases in size from the fluid inlet 18 to the fluid outlet 20 so that fluid entering the pump 10 is compressed as it is conveyed from the fluid inlet 18 to the fluid outlet 20.

The threads 30, 32 of the rotors 26, 28 each have a pitch that increases towards the fluid outlet 20. In the embodiment illustrated in FIG. 1, the pitch of the rotors increases progressively along the rotors. This increase in the pitch of the threads 30, 32 towards the fluid outlet 20 serves to further increase the surface area of the stages of the rotors 26, 28 that experience the greatest rise in temperature during use of the pump 10. Consequently, the surface area of the stator 12 surrounding these stages of the rotors 26, 28, and therefore able to act as a heat sink for dissipating heat from these stages of the rotors 26, 28, is also increased. During operation, this increase in surface area when combined with the heat flow through the rotors 26, 28 towards the gear box, enables heat to be removed from the rotors 26, 28 at a sufficient rate to avoid clashing between the rotors 26, 28 and the inner surface of the stator 12 without additionally requiring any flow of coolant through the rotors 26, 28.

Figure 2:
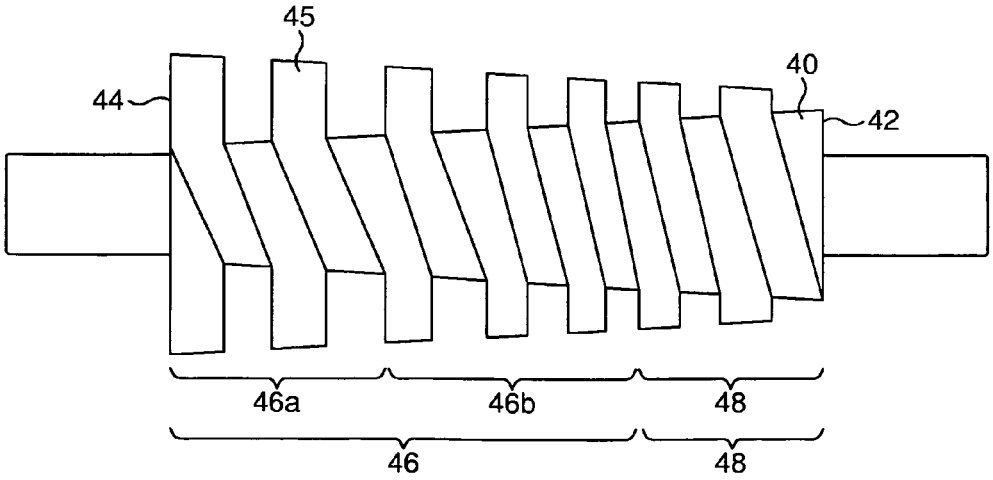
FIG. 2 illustrates a cross-sectional view of another rotor suitable for use in the pump of FIG. 1.

FIG. 2 illustrates an alternative rotor 40 suitable for use in the screw pump 10. Similar to the rotors 26, 28 in FIG. 1, the root of rotor 40 has a shape that tapers from one end 42 towards the other end 44 thereof, such that when the rotor 40 is installed in the stator 12 the root of the rotor 40 tapers from the fluid outlet 20 towards the fluid inlet 18, and has a helical vane or thread 45 formed on the outer surface thereof. The tip diameter of the helical thread 45 is correspondingly tapered to permit close tolerance meshing with the root of a cooperating rotor (not shown).

In this embodiment, the rotor 40 is subdivided into a first section 46 that will be proximate the fluid inlet 18 when the rotor 40 is installed in the stator 12, and a second section 48 that will be proximate the fluid outlet 20 when the rotor 40 is installed in the stator 12. In this embodiment, the second section 48 extends for at least the final two stages, or exhaust stages, of the rotor 40. The thread of the second section 48 has a pitch that increases, for example linearly or exponentially, towards end 42, and preferably such that when the rotor 40 is installed in the stator 12, the stages of the second section 48 have similar pumping volumes to one another.

The thread of the first section 46 has a pitch that varies differently to that of the thread of the second section 48. The pitch of the thread of the first section 46 may be constant, decrease from end 44 towards end 42, or may increase at a different rate to the thread of the second section 48. Alternatively, as illustrated in FIG. 2, the first section 46 may be sub-divided into a first sub-section **46*a* proximate end 44, and a second sub-section 46*b* proximate the second section 48. As each stage of the rotor is defined by a 360° turn of the thread of the rotor, and the thread is continuous the stages are not necessarily regarded as discrete integer portions. In this embodiment, the first sub-section 46*a* extends beyond the first inlet stage, for example to 1.5, 2 or up to 3 stages, of the rotor 40, and the second sub-section also extends for at least approximately two stages. The thread of the first sub-section 46*a* also has a pitch that increases towards end 42, and preferably such that when the rotor 40 is installed in the stator 12, the stages of the first sub-section 46*a* have a similar pumping volume to one another. This assists in maintaining a high pumping speed at higher pressures. In contrast, the thread of the second sub-section 46*b* has a pitch that decreases towards end 42**.

Consequently, during the use of the pump 10 incorporating two rotors 40, the majority of the reduction in volume of the gas passing from the fluid inlet 18 to the fluid outlet 20 is performed by the second sub-sections **46*b* of the rotors 40. This contributes towards reducing the ultimate power of the pump which, in turn, results in less heat being generated in the second sections 48 of the rotors 40, thereby reducing the temperature of the exhaust stages of the rotors 40**.

Figure 3:
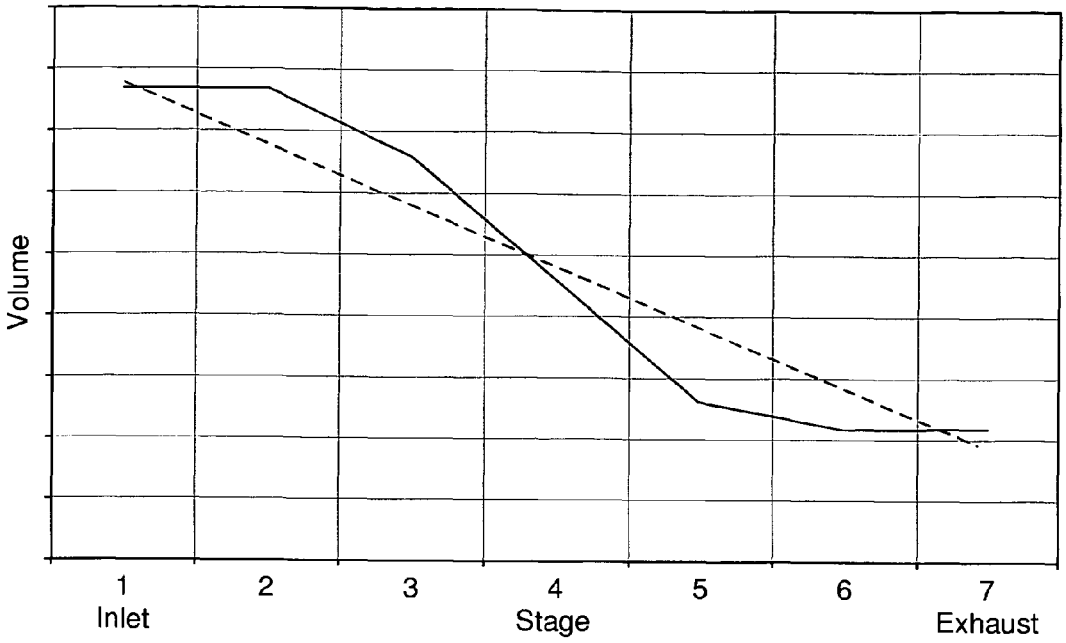
FIG. 3 is a graph comparing the change in volumetric capacity of the stages of a constant pitch rotor and the stages of a rotor similar to that illustrated in FIG. 2.

FIG. 3 is a graph that illustrates the variation in volumetric capacity of the different stages through a screw pump having a rotor of the type illustrated in FIG. 2. In the graph, the stages are numbered from 1 to 7 from the fluid inlet 18 to the fluid outlet 20. Stages 1 and 2 provide the inlet stages of the first sub-section **46*a* of the rotor 40, stages 3 and 4 provides the stages of the second sub-section 46*b* of the rotor 40, and stages 5 to 7 provide the exhaust stages of the second section 48 of the rotor 40. Stage 5 may alternatively be considered as forming part of the second sub-section 46*b* of the rotor 40**.

As described above, the exhaust stages 5 to 7 have very similar volumetric capacities. These exhaust stages elevate the magnitude of the pressure of the gas passing through the pump to the greatest extent, for example from around 1 mbar at the inlet of stage 5 to around 1000 mbar at the outlet of stage 7. It is, therefore, these exhaust stages that undertake the greatest level of work done and consequently experience the greatest increase in temperature during use of the pump.

Due to the higher pressure of the gas being conveyed through these exhaust stages, there is also a greater level of back leakage between these stages. By providing the exhaust stages with a lower volumetric capacity than the preceding stages, with the volumetric capacity of the (two or three) exhaust stages being substantially the same, the impact, in terms of heat generation and power requirements at ultimate, of this back leakage can be minimised.

Furthermore, the power requirement of each stage when the pump is operating at ultimate is governed by the relationship between the volume and the change in pressure of that stage. Hence, in order to retain lower ultimate power requirements it is desirable to have exhaust stages with relatively small and substantially equal volumetric capacities.

Conversely, it is desirable to provide inlet stages having a relatively large volumetric capacity, with the volumetric capacity of the (two or three) inlet stages being substantially the same. In so doing, the ability of the pump 10 to receive a high volume of gas at elevated pressures, for example when the pump is first switched on, is enhanced. As gas can be readily conveyed between the inlet stages without experiencing any significant obstruction to the gas flow, back leakage of gas to the fluid inlet 18 can be avoided and an acceptable pumping speed at high inlet pressures can be achieved.

The dashed line in FIG. 3 illustrates the change in the volumetric capacity of the stages of a pump comprising tapered rotors having threads with a constant pitch. The full benefits of increased pumping speed at high inlet pressures and reduced power requirements at ultimate pressure are not achieved when such a configuration is implemented.

The profile of the rotors illustrated in FIGS. 1 and 2 has a substantially square cut or rectangular form, a small amount of non-orthogonality being introduced in the cross section of the thread in the tip portion to enable intermeshing of the teeth to be achieved. Alternatively, a trapezoidal form may be used. As another alternative, a pair of cooperating conjugate screw rotors may be used, that is rotors having a form whereby the rotors cooperate in such a manner that the shape of one rotor is determined by the form of the other rotor to achieve very close coupling between the rotors. Good sealing properties between cooperating conjugate rotors are generally achieved.

Figure 4:
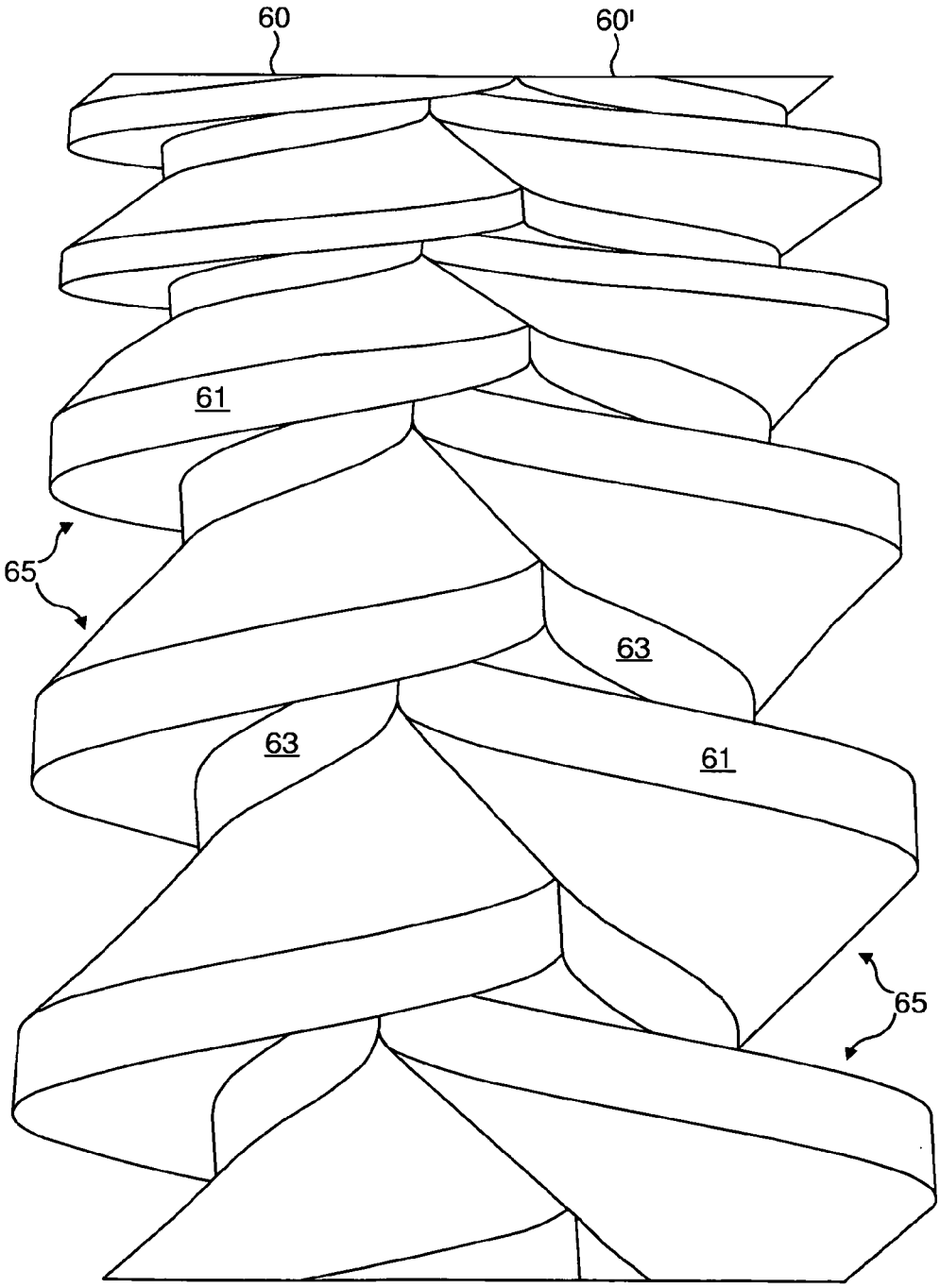
FIG. 4 illustrates another pair of intermeshing rotors suitable for use in the pump of FIG. 1.

FIG. 4 illustrates a pair of intermeshing conjugate screw rotors 60, 60'. As with the rotor illustrated in FIG. 2, each rotor 60, 60' has a tapered root, each root having an external thread 65. The thread 65 comprises a longitudinally extending tip contact portion 61 at a radial extremity of the rotor 60, and a longitudinally extending root contact portion 63 at a radially innermost portion of the rotor 60. In operation, the tip contact portion 61 interacts with the internal surface of the stator (not shown) and also with the root contact portion 63 of the cooperating rotor 60'.

Figure 5:
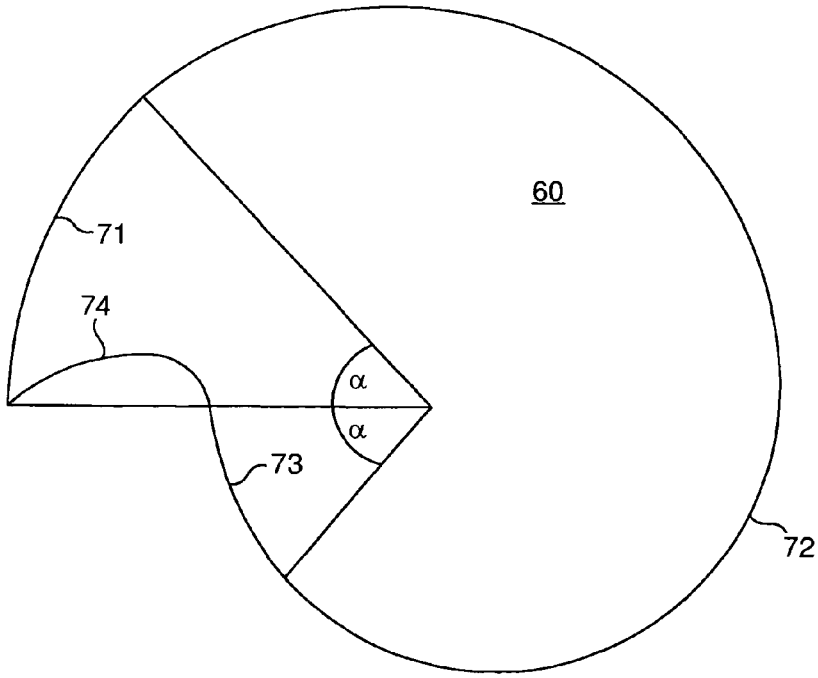
FIG. 5 illustrates an axial cross section of one of the rotors of FIG. 4.

FIG. 5 illustrates an axial cross section of the conjugate screw rotor of FIG. 4. The example cross section illustrates how the external profile of the rotor 60 is made up from a number of sections, in this example four sections 71, 72, 73, 74, that can each be separately defined. The first section 71 describes a circular arc, and leads into a second section 72 which is formed from a generally spiral shaped section. The second section 72 describes, for example, an Archimedean spiral or an involute spiral. Alternatively, the second section 72 may comprise a number of interconnected spiral sub-sections. For example, each sub-section may be an Archimedian spiral of varying form. Each sub-section will be configured so as to mesh with a corresponding sub-section on the cooperating rotor 60' upon rotation of the two rotors during operation of the pump. As a consequence, it is unlikely that both rotors have the same axial cross sectional profile, especially if the second section 72 is formed from a single section rather than several sub-sections. If the spiral section describes an involute spiral then the cross sectional profiles may be identical.

The second section 72 is followed by a third section 73, which also describes a circular arc. The final, fourth section 74 is a developed, concave section which leads into the first section 71.

Advantages associated with the use of a conjugate screw rotor configuration are primarily related to the enhanced sealing properties that exist between the cooperating rotors. When assembled into a stator, rectangular or trapezoidal-form rotors generally form a "blow-hole" at the point of intersection of the intermeshing rotors and the stator. This blow-hole results in a certain amount of fluid being transferred from the fluid chamber 34 (as denoted in FIG. 1) formed between one rotor and the stator to the fluid chamber 34 formed between the other rotor and the stator. However, with a conjugate screw form a very close seal can be achieved between each stage such that a discrete sequence of axial chambers can be achieved to minimise leakage between the stages.

The sealing properties associated with a conjugate screw rotor configuration can be maintained even when steep changes in pitch are implemented along the length of the rotors 60, 60'. As discussed above, it is desirable to vary the pitch along the length of the rotors to achieve optimum compression from a central portion of the rotors whilst maintaining reasonable overall power requirements of the pump and thermal characteristics of the exhaust stages of the pump.

The tapered nature of the root of the rotor illustrates one way in which the cross sectional profile of the rotor can vary along the shaft, that is from the fluid outlet 20 towards the fluid inlet 18. For example, the radius of each the first and third sections 71, 73 may increase or decrease to form the taper, with the dimensions of the other sections 72, 74 adapting to accommodate the radial changes in the circular arc sections. However, other parameters may be varied along the shaft. For example, the angular extent (a) of each of the first and third sections 71, 73 may be varied with longitudinal distance along the shaft. Increasing the angular extent (a) has the effect of increasing the longitudinal contact portions 61, 63 of the rotors. Consequently the surface areas brought into contact with the stator and the cooperating rotor can be correspondingly increased independently of the pitch of the thread, thereby improving heat transfer and sealing properties between the rotors and between each rotor and the stator. Whilst the volumetric capacity of the respective stage will also be affected, the variation in volume is dominated by any change in pitch.

As discussed above, the second section 72 of the external profile, or locus of the radial extremity of the axial cross section, may comprise a number of interconnected spiral sub-sections. The extent and definition of these sub-sections may also be varied with longitudinal distance along the shaft.

While the foregoing description and drawings represent the preferred embodiments of the present invention, it will be apparent to those skilled in the art that various changes and modifications may be made therein without departing from the true spirit and scope of the present invention.

We claim:

1. A screw pump comprising a stator having a fluid inlet and a fluid outlet, the stator housing first and second externally threaded, tapered rotors mounted on respective shafts and adapted for counter-rotation within the stator to compress fluid as it is conveyed from the fluid inlet to the fluid outlet, each rotor comprising a first section proximate the fluid inlet and a second section proximate the fluid outlet, wherein the second section comprises a plurality of thread turns and wherein a thread of the second section has a pitch that increases at each thread turn from the first section to the fluid outlet.

2. The pump according to claim 1 wherein the first section comprises a first sub-section proximate the fluid inlet, and a second sub-section proximate the second section, and wherein a pitch of the thread of the first sub-section is different to that of the thread of the second sub-section.

3. The pump according to claim 2 wherein a pitch of the second sub-section decreases towards the fluid outlet.

4. The pump according to claim 2 wherein the pitch of the first sub-section increases towards the fluid outlet.

5. The pump according to claim 1 wherein the threads have a rectangular cross section.

6. The pump according to claim 1 wherein the threads have a conjugate form.

7. The pump of claim 1 wherein a pitch of the thread of the first section decreases towards the fluid outlet.

8. A screw pump for pumping gases comprising a stator having a fluid inlet and a fluid outlet, the stator housing first and second externally threaded rotors mounted on respective shafts and adapted for counter-rotation within the stator to compress fluid as it is conveyed from the fluid inlet to the fluid outlet, an axial cross-section of the rotors varying from the fluid inlet towards the fluid outlet, each rotor having a plurality of stages wherein threads on the rotors have a pitch that increases at each of multiple successive stages towards the fluid outlet.

9. The screw pump of claim 8, wherein the rotors are tapered.

10. The screw pump of claim 9 wherein each rotor comprising a first section of stages proximate the fluid inlet and a second section of stages proximate the fluid outlet, wherein threads of the second section of stages have a pitch that increases towards the fluid outlet.

11. The screw pump of claim 10, wherein threads of the first section of stages have a pitch that is substantially constant.

12. The screw pump of claim 10, wherein a pitch of threads of the first section varies towards the fluid outlet.

13. The screw pump of claim 12, wherein the pitch of threads of the first section decreases towards the fluid outlet.

14. The screw pump of claim 12, wherein the first section comprises a first sub-section proximate the fluid inlet, and a second sub-section proximate the second section, and wherein a pitch of threads of the first sub-section is different to that of a pitch of threads of the second sub-section.

15. The screw pump of claim 14, wherein the pitch of threads of the second sub-section decreases towards the fluid outlet.

16. The screw pump of claim 14, wherein the pitch of the first sub-section increases towards the fluid outlet.

17. The screw pump of claim 8, wherein a locus of a radial extremity of the axial cross section of each rotor varies from the fluid outlet towards the fluid inlet thereby to effect a change in contact surface of each rotor.

18. The screw pump of claim 8, wherein the pitch of the threads increases progressively from the fluid inlet to the fluid outlet.

19. The screw pump of claim 8 wherein the pitch of the threads increases from part way along the rotor to the fluid outlet.

20. The screw pump of claim 8, wherein the threads have a rectangular cross section.

21. The screw pump of claim 8, wherein the threads have a conjugate form.

22. The screw pump of claim 8 wherein each of the multiple successive stages comprises a three-hundred sixty degree turn of the thread of the rotor.

23. The screw pump of claim 22 wherein the thread is continuous and successive stages are not regarded as integer portions.

* * * * *